United States Patent [19]

Abraham et al.

[11] 3,958,852

[45] May 25, 1976

[54] ELECTRICAL CONNECTOR

[75] Inventors: Gerald Milton Abraham, Reynoldsburg; Peter John Campbell, Columbus, both of Ohio

[73] Assignee: Bell Telephone Laboratories, Incorporated, Murray Hill, N.J.

[22] Filed: Apr. 15, 1975

[21] Appl. No.: 568,303

[52] U.S. Cl. ..... 339/91 P; 339/176 MP; 339/177 R

[51] Int. Cl.[2] ..... H01R 17/06; H01R 27/02

[58] Field of Search ..... 339/17 C, 17 L, 176, 339/177, 91

[56] References Cited

UNITED STATES PATENTS

| | | | |
|---|---|---|---|
| 2,937,357 | 5/1960 | Kennedy | 339/177 MP |
| 3,089,115 | 5/1963 | Wicks | 339/177 R |
| 3,160,459 | 12/1964 | Greco et al. | 339/176 MP |
| 3,176,261 | 3/1965 | Greco et al. | 339/17 LM |
| 3,482,201 | 12/1969 | Schneck | 339/176 MP |
| 3,594,699 | 7/1971 | Jayne et al. | 339/176 MP |
| 3,594,708 | 7/1971 | Lalonde | 339/176 MP |
| 3,689,865 | 9/1972 | Pierini et al. | 339/17 L |

OTHER PUBLICATIONS

Proceedings of the National Electronic Packaging and Production Conference, Apr. 7–8–9, 1970, Impedance Matched Printed Circuit Connectors, H. E. Henschen et al., pp. 4–35 to 4–45.

*Primary Examiner*—Roy Lake
*Assistant Examiner*—Neil Abrams
*Attorney, Agent, or Firm*—A. A. Tirva

[57] ABSTRACT

An electrical connector having a housing with an opening contains within the housing a ground plane, a plurality of coaxial jacks, and a first and second plurality of contact springs. Each coaxial jack has a tubular element which is fastened to the ground plane and a socket which is fastened to the housing. Each first plurality spring has one end connected to the ground plane, and each second plurality spring has one end connected to the socket of a different one of the coaxial jacks. The other ends of the first and second pluralities of springs extend into the opening.

10 Claims, 8 Drawing Figures

ELECTRICAL CONNECTOR

BACKGROUND OF THE INVENTION

This invention relates to an electrical connection device which is more particularly described as an electrical connector which provides separable connections between coaxial lines and printed wiring board circuits.

Edgeboard connectors designed to provide connections between low frequency signal lines and printed wiring board circuits have been utilized in the past to connect coaxial lines to printed wiring board circuits when signal distortion caused by reflected waves, which are the result of discontinuities or impedance mismatch in a connector, could be tolerated. A way to minimize signal distortion in such a connector is to try to make the termination of a coaxial line within the connector housing an extension of the coaxial line. Several such connectors are described and shown on pages 4–35 to 4–45 of an article by H. E. Henschen et al published in the Proceedings of the Technical Program of the National Electronic Packaging and Production Conference on Apr. 7, 8, 9, 1970. In a connector shown on page 4–39 of the Henschen et al article, three contact spring assemblies are utilized to terminate one coaxial line. One contact spring assembly terminates the center conductor while the other two, located on each side of the center conductor, terminate the shield portion of the coaxial line. Mechanical and electrical connections between the coaxial line and the spring contact assemblies are made by crimping the center conductor and the shield portion of the coaxial line to the spring assemblies. These connections are more or less permanent connections in the sense that the coaxial line cannot be readily detached from the spring assemblies.

When signal distortion is such that an arrangement as the one described above cannot be used to interconnect coaxial lines and printed wiring board circuits, another possible solution is to mount coaxial jacks on a printed wiring board to serve as receptacles for plugs which terminate coaxial lines. Even though the individual coaxial plug-jack combination provides an electrically and mechanically sound, separable connection, such a connection arrangement has several disadvantages. Coaxial jacks, because of their physical construction, generally require a substantial amount of mounting space on a printed wiring board causing an increase in the size of each individual board, and if the jacks are mounted on one of the major surfaces of a board, they generally cause an increase in the spacing between two adjacent boards.

Therefore, it is an object to provide an electrical connector for interconnecting coaxial lines with printed wiring board circuits.

Another object is to provide an electrical connector which extends a coaxial line to the edge of a printed wiring board.

These and other objects are realized in one illustrative embodiment of the invention in which an electrical connector has a housing with an opening, a ground plane, a plurality of coaxial jacks, and first and second pluralities of contact springs, all mounted within the housing. Each jack includes a conductive tubular element connected to the ground plane and a conductive socket which is mounted inside the tubular element. One end of each spring of the first plurality is connected to the ground plane, and one end of each spring of the second plurality is connected to a socket of a different one of the coaxial jacks. Each spring and socket are mechanically connected together in a sense that they are formed from a continuous piece part. The other end of each spring of the first and second plurality extend into the opening.

A feature of the invention is a plurality of coaxial jacks mounted in the connector housing, each jack having a tubular element connected to the ground plane and a socket mounted inside the tubular element.

Another feature of the invention is a first plurality of contact springs connected to the ground plane and extending into the opening.

A further feature is a second plurality of contact springs, each connected to the socket of a different one of the coaxial jacks and each extending into the opening.

BRIEF DESCRIPTION OF THE DRAWING

A better understanding of the invention may be derived from the detailed description following as that description is considered with respect to the attached drawings in which.

DETAILED DESCRIPTION

Figure 1:
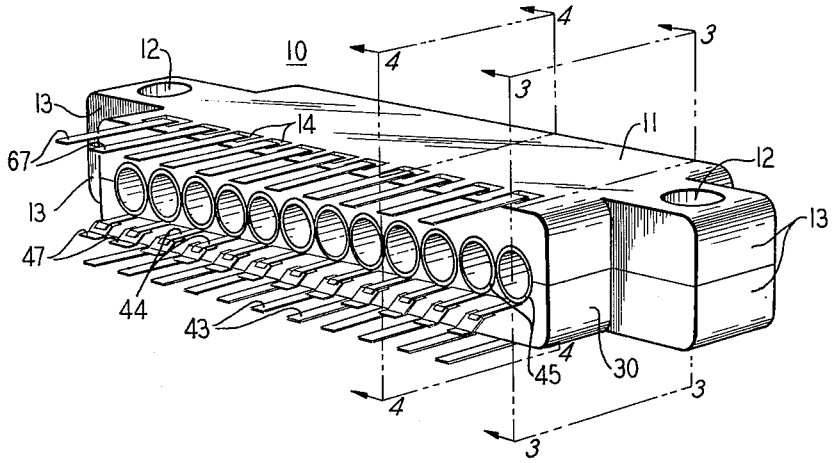
FIG. 1 is a perspective view of an electrical connector.
Figure 2:
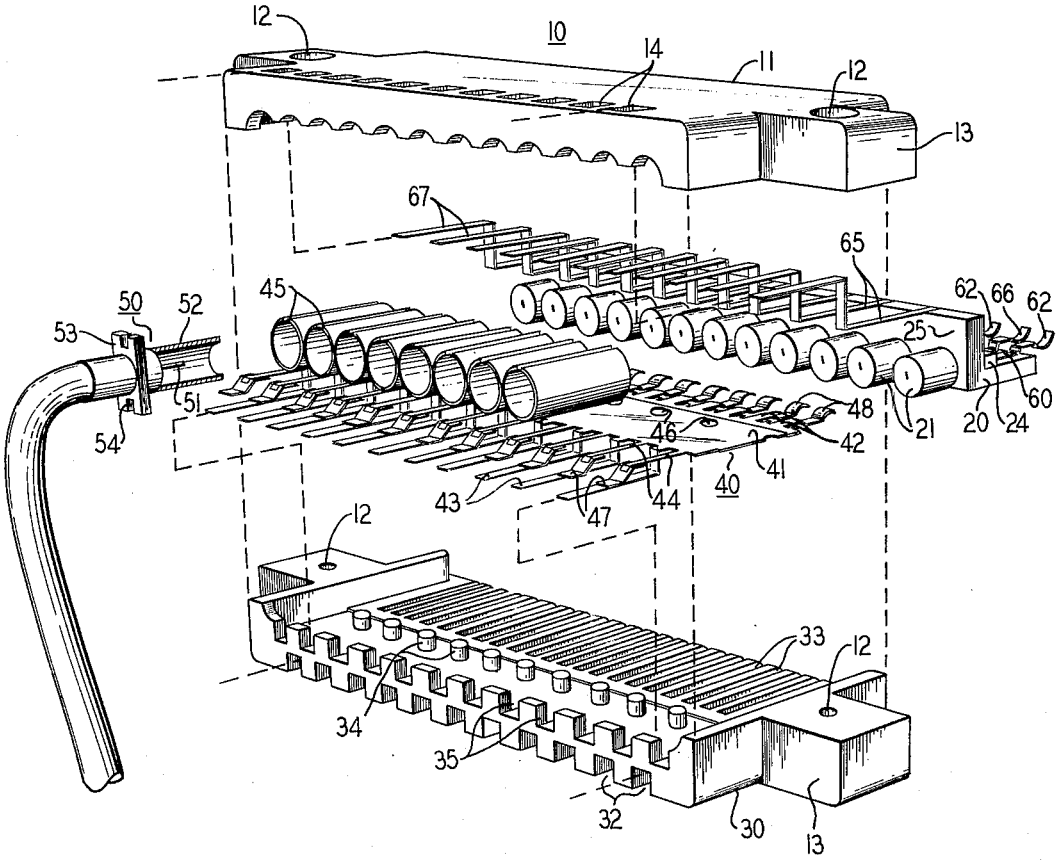
FIG. 2 is an exploded perspective view of the connector shown in FIG. 1.
Figure 5:
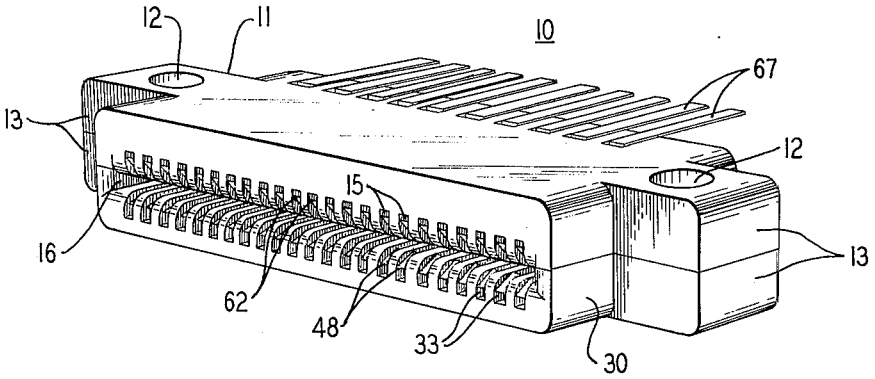
FIG. 5 is a perspective view of the connector shown in FIG. 1 rotated 180° about its vertical axis.

Referring now to FIGS. 1, 2 and 5 there is shown an electrical connector 10 which provides wire wrap terminations for low-frequency signal lines and separable terminations for high-frequency coaxial lines and printed wiring board circuits. The connector has a housing of an insulating material having an opening 16, shown in FIG. 5, in one of its longitudinal edges. The housing consists of a top portion 11, center portion 20, shown in FIG. 2, and a bottom portion 30. All three portions are held together with suitable fasteners (not shown) passing through apertures 12, located in the wing portions 13 of the top and bottom portions of the connector housing.

Figure 3:
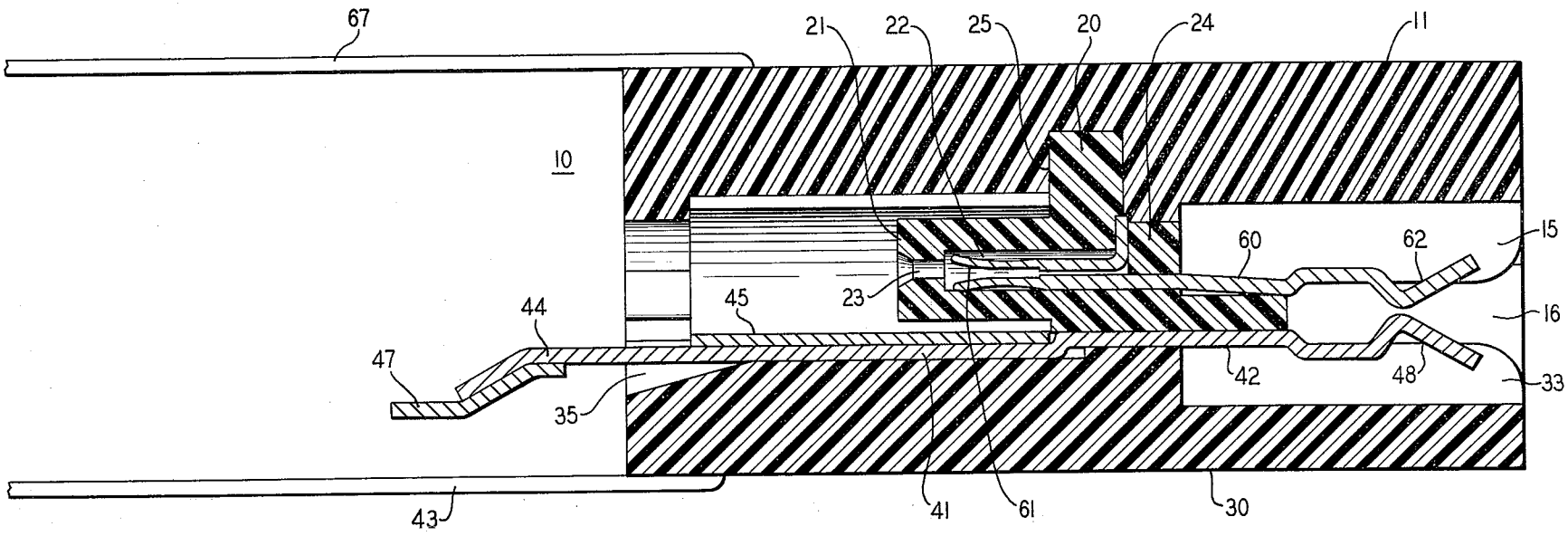
FIG. 3 is a sectional view of the connector as shown generally along plane 3—3 of FIG. 1.
Figure 4:
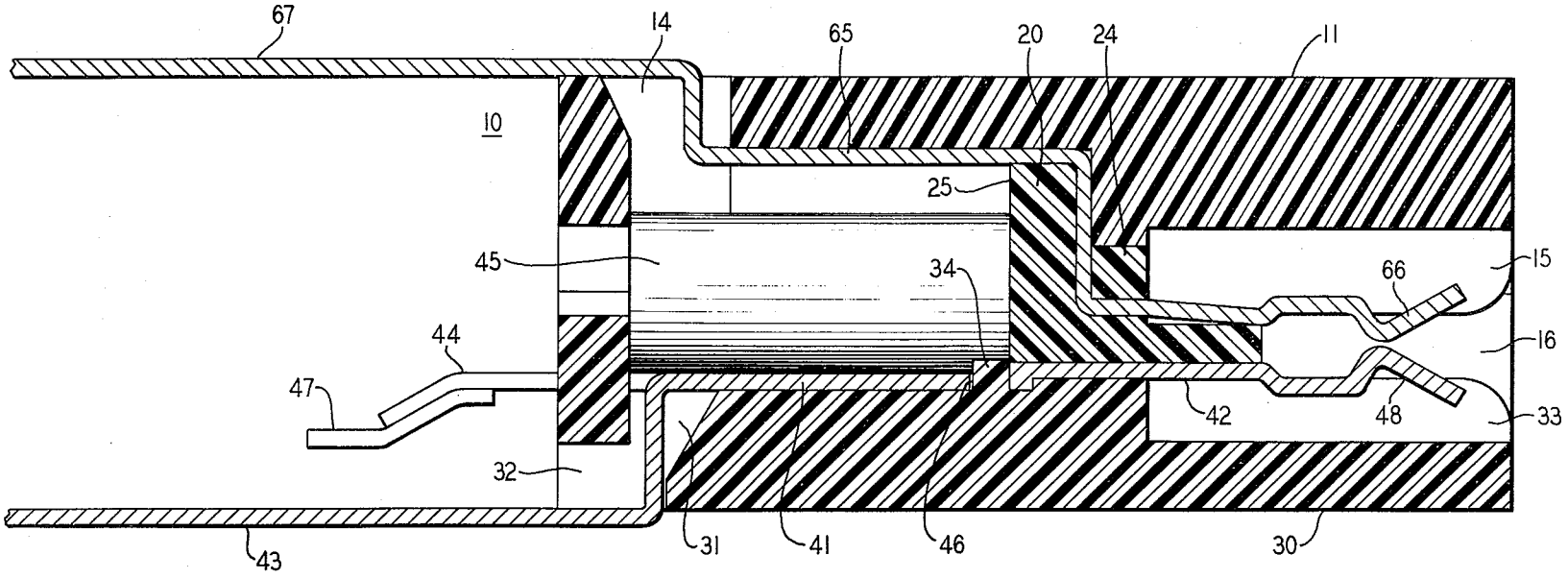
FIG. 4 is a sectional view of the connector as shown generally along plane 4—4 of FIG. 1.

Referring now to FIGS. 2, 3 and 4, there is shown a ground plane assembly 40 mounted within a connector housing 10. The ground plane assembly has a generally rectangular, conductive ground plane 41 containing a plurality of apertures 46, shown in FIGS. 2 and 4. Each aperture 46 permits passage of one of a plurality of projections 34 extending normally from the top surface of the bottom portion 30. These projections locate the ground plane 41 in the bottom portion 30 of the connector housing and keep the ground plane in place. A plurality of conductive, tubular elements 45, each element having a longitudinal slot, is connected to the ground plane 41. A different one of the tubular elements is included in the makeup of each of a plurality of coaxial jacks described later on in this application. Several of the tubular elements 45 have been omitted from FIG. 2 in order to show more clearly the construction of the ground plane assembly 40.

A first plurality of contact springs 42 is shown mounted in the connector housing 10. Each spring has one end connected to the ground plane 41 and the other end 48 extending into the opening 16.

A first plurality of terminals 43 for wire wrapped termination of ground leads associated with low frequency signal lines extends from the connector housing 10 through a plurality of ports 31, shown in FIG. 4, located in the bottom portion 30 of the housing. Each terminal 43 has one end connected to the ground plane 41.

Referring now to FIGS. 2 and 3 there is shown a second plurality of contact springs 60 attached to the generally L-shaped center portion 20 by means of a substantially rectangular, insulating bar 24. The L-shaped center portion 20 has a surface 25 from which a plurality of cylindrical projections 21 extend generally normal to the surface 25. Each cylindrical projection 21 extends into a different one of the tubular elements 45, and each projection 21 has a cavity 22 and an aperture 23. Each second plurality spring has one end connected to conductive socket 61 which is mounted inside a different one of the tubular elements 45 by being positioned within a cavity 22 of one of the cylindrical projections 21. Each spring and socket are mechanically connected together in a sense that they are formed from a continuous piece part. As shown in FIG. 3, the other end 62 of contact spring 60 extends into the opening 16.

Referring now to FIGS. 2 and 4 there is shown a second plurality of terminals 67 for wire wrapped termination of low frequency signal lines extending from the connector housing 10 through a second plurality of ports 14 located in the top portion 11 of the connector housing. A third plurality of contact springs 65 is attached to the center portion 20 in an alternate sequence with contact springs 60 so that ends 66 of the contact springs 65 are interspersed between ends 62 of the contact springs 60. Each spring 65 has a first end connected to a different one of the second plurality terminals 67 and a second end 66 extending into the opening 16.

Referring now to FIGS. 3 and 4, there are shown two cross-sectional views of the connector housing 10 showing the ends 62 of second plurality springs 60 and the ends 66 of the third plurality springs 65 positioned in the opening 16 opposite the ends 48 of the first plurality springs 42. The ends 62 and 66 and the ends 48 are substantially concavely curved toward each other. The ends 62 and 66 are positioned so that they are partially received by a plurality of slots 15 located in the top portion 11 of the connector housing. The ends 48 are arranged to be received by a plurality of slots 33 located in the bottom portion 30 of the connector housing. When a printed wiring board, a ceramic substrate, or some other device containing metallic surface paths on its top and bottom surfaces is inserted into the opening 16, it forces contact spring ends 62 and 66 and the contact spring ends 48 apart and partially into slots 15 and 33, respectively. Spring action, developed by the contact spring ends because of the separation, insures good mechanical and electrical contact between the springs and the metallic circuit paths.

Referring now to FIGS. 2, 3 and 4, there is shown a plurality of coaxial jacks mounted in the connector housing 10, each jack comprising a tubular element 45 and a conductive socket 61 combination. Tubular element 45 has a longitudinal slot which permits the tubular element to receive a shield portion 52 of a coaxial plug 50 having an outside diameter larger than the inside diameter of a tubular element 45, thereby insuring an interference fit type connection between the shield portion 52 and the tubular element 45. Each socket 61 is arranged to receive via an aperture 23 a center conductor 51 of the coaxial plug 50. The cylindrical projections 21 are made of an insulating material insuring electrical separation between the center conductor 51 and the outer shield portion 52.

Figure 6A:
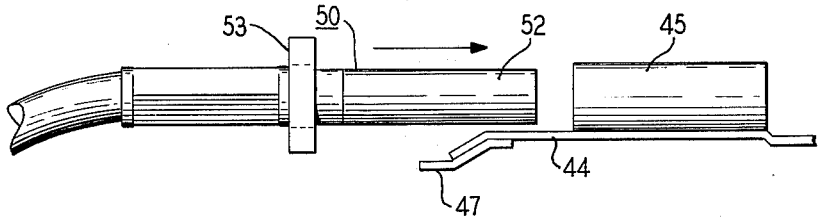
FIGS. 6A through 6C are a series of orthogonal side views of the coaxial plug and a locking spring and tab combination of FIG. 2 shown in their relative positions during a latching operation.
Figure 6B:
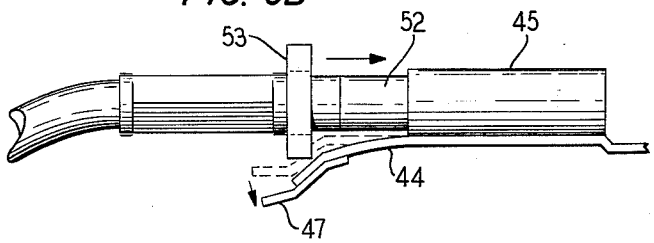
Figure 6C:
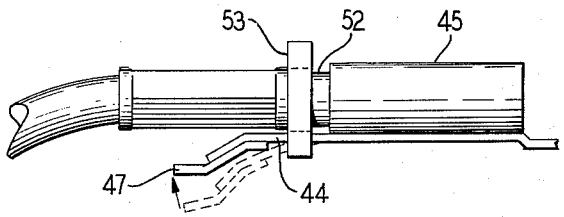

To prevent accidental removal of the plug 50 from the tubular element 45 and socket 61 combination, a plurality of locking springs 44 extends from the connector housing 10. Each locking spring 44 has one end attached to the ground plane 41. A tab 47 is attached to the free end of each locking spring 44. As shown in FIGS. 6A through 6C, the locking spring 44 and tab 47 combination is shaped so as to permit a backplate 53 of the coaxial plug 50 to push down on the tab 47 and spring 44 and thus easily slide over the tab 47 when the plug is inserted into a jack. Once the backplate 53 passes over the tab 47, as shown in FIG. 6C, locking spring 44 moves up to its normal position by entering a recess 54 in the backplate 53 of a coaxial plug 50. This return action by the locking spring 44 pushes the tab 47 up against the backplate 53, preventing an accidental removal of the plug from the coaxial jack.

It is to be understood that the above-described arrangement is illustrative of the application of the principles of the invention. While the instant illustrative embodiment describes and depicts an electrical connector having coaxial jacks, terminals for wire wrap terminations, and springs which contact metallic circuit paths of printed wiring boards, the scope of the invention is not so limited. Numerous other arrangements may be devised by those skilled in the art without departing from the spirit and scope of the invention.

What is claimed is:

1. An electrical connector comprising:

a housing having an opening;

a ground plane mounted within the housing;

a plurality of coaxial jacks mounted in the housing, each jack having a conductive tubular element which is connected to the ground plane and a conductive socket which is mounted inside the tubular element;

a first plurality of contact springs, each spring having a first end connecting to the ground plane and a second end extending into the opening; and a second plurality of contact springs, each spring having a first end connecting to a different socket of one of the coaxial jacks and a second end extending into the opening.

2. An electrical connector in accordance with claim 1 further comprising:

a first plurality of terminals extending from the housing, each terminal being connected to the ground plane.

3. An electrical connector in accordance with claim 2 further comprising:

a second plurality of terminals extending from the housing, and a third plurality of contact springs, each spring having a first end connecting to a different one of the second plurality of terminals and a second end extending into the opening.

4. An electrical connector in accordance with claim 3 wherein the second the third pluralities of springs are attached to the connector housing in an alternate sequence so that only springs from different pluralities are located adjacent to one another.

5. An electrical connector in accordance with claim 4 wherein the connector housing has first and second pluralities of ports through which the first and second pluralities of terminals extend from the connector housing, respectively.

6. An electrical connector in accordance with claim 4 wherein the ends of the second and third pluralities of springs extending into the opening are positioned opposite the ends of the first plurality of springs, which also extend into the opening.

7. An electrical connector in accordance with claim 6 wherein the ends of the opposite positioned springs are substantially concavely curved towards each other.

8. An electrical connector in accordance with claim 1, further comprising:

a plurality of locking springs extending from the housing, each locking spring being attached to the ground plane.

9. An electrical connector in accordance with claim 8 wherein each locking spring has a tab attached to it.

10. An electrical connector comprising:

a housing having an opening;

a ground plane mounted within the housing;

a plurality of coaxial jacks mounted in the housing, each jack having a conductive tubular element which is connected to the ground plane, and a conductive socket which is mounted inside the tubular element;

a first plurality of contact springs, each spring having a first end connecting to the ground plane and a second end extending into the opening;

a second plurality of contact springs, each spring having a first end formed into a different socket of one of the coaxial jacks and a second end extending into the opening;

a first plurality of terminals extending from the housing, each terminal being connected to the ground plane;

a second plurality of terminals extending from the housing, and a third plurality of contact springs, each spring having a first end connecting to a different one of the second plurality of terminals and a second end extending into the opening.

* * * * *